US005855034A

United States Patent [19]

Pitman

[11] Patent Number: 5,855,034

[45] Date of Patent: Jan. 5, 1999

[54] METHOD AND APPARATUS FOR CLEANING COLORANT APPLICATORS

[75] Inventor: Frank Mark Pitman, Duncan, S.C.

[73] Assignee: Milliken Research Corporation, Spartanburg, S.C.

[21] Appl. No.: 771,236

[22] Filed: Dec. 20, 1996

[51] Int. Cl.[6] ..... B08B 3/02

[52] U.S. Cl. ..... 8/151; 68/205 R; 134/24; 134/104.1; 134/181; 239/752

[58] Field of Search ..... 68/13, 205 R, 68/202; 8/151; 118/302; 134/181, 198, 166 R, 172, 22.1, 24, 104.1; 239/263.11, 264, 752

[56] References Cited

U.S. PATENT DOCUMENTS

| | | | |
|---|---|---|---|
| 2,218,811 | 10/1940 | Chaussabel . | |
| 3,093,091 | 6/1963 | Tax et al. . | |
| 3,443,878 | 5/1969 | Webber . | |
| 3,545,459 | 12/1970 | Phillips . | |
| 4,111,012 | 9/1978 | O'Neill, Jr. | 68/205 R |
| 4,148,668 | 4/1979 | Stewart, Jr. . | |
| 4,281,848 | 8/1981 | Youngers . | |
| 4,285,353 | 8/1981 | Colomer | 134/181 |
| 4,370,932 | 2/1983 | Etcheparre et al. . | |
| 4,640,175 | 2/1987 | Hoshino . | |
| 4,701,242 | 10/1987 | Scarano et al. | 239/752 |
| 4,728,041 | 3/1988 | Draxler et al. . | |
| 4,785,836 | 11/1988 | Yamamoto | 134/104.1 |
| 4,881,561 | 11/1989 | Schwarzwalder | 123/166 R |
| 4,912,946 | 4/1990 | Keller | 68/5 D |
| 4,981,268 | 1/1991 | Hour | 134/181 |
| 4,993,444 | 2/1991 | Toriyama et al. | 134/181 |
| 5,025,818 | 6/1991 | Kalar | 134/171 |
| 5,081,731 | 1/1992 | Yamakita et al. | 68/205 R |
| 5,127,363 | 7/1992 | Nakamura et al. | 134/104.1 |
| 5,159,824 | 11/1992 | Stewart, Jr. . | |
| 5,161,395 | 11/1992 | Wethington . | |
| 5,193,363 | 3/1993 | Petty . | |
| 5,344,084 | 9/1994 | Andrews et al. | 239/752 |
| 5,353,996 | 10/1994 | Gallacher et al. | 239/752 |
| 5,559,605 | 9/1996 | Reed . | |

FOREIGN PATENT DOCUMENTS

| | | | |
|---|---|---|---|
| 0 080 001 | 6/1983 | European Pat. Off. . | |
| 4-153357 | 5/1992 | Japan | 68/205 R |
| 1024683 | 3/1966 | United Kingdom . | |
| 1284702 | 9/1972 | United Kingdom . | |

*Primary Examiner*—Frankie L. Stinson
*Attorney, Agent, or Firm*—Terry T. Moyer; George M. Fisher; James M. Robertson

[57] ABSTRACT

This Invention is a method and apparatus for spraying water on the underside of a series of colorant applicators in order to rinse excess colorant from the machine parts. There is a water manifold having a first end portion connected to an upper trolley by a pivoting joint and a second end portion attached to a lower trolley by both a pivoting joint and a sliding joint. Both the upper and lower trollies are constrained in the horizontal, vertical, and rotational direction by a series of cam followers. The extra degrees of freedom provided by the two pivoting joints and the sliding joint insure that no binding occurs. An optional feedback control system can be added utilizing a rotational position transducer to sense the angle of the water manifold so that the motion of the trolleys can be retarded or advanced accordingly.

28 Claims, 5 Drawing Sheets

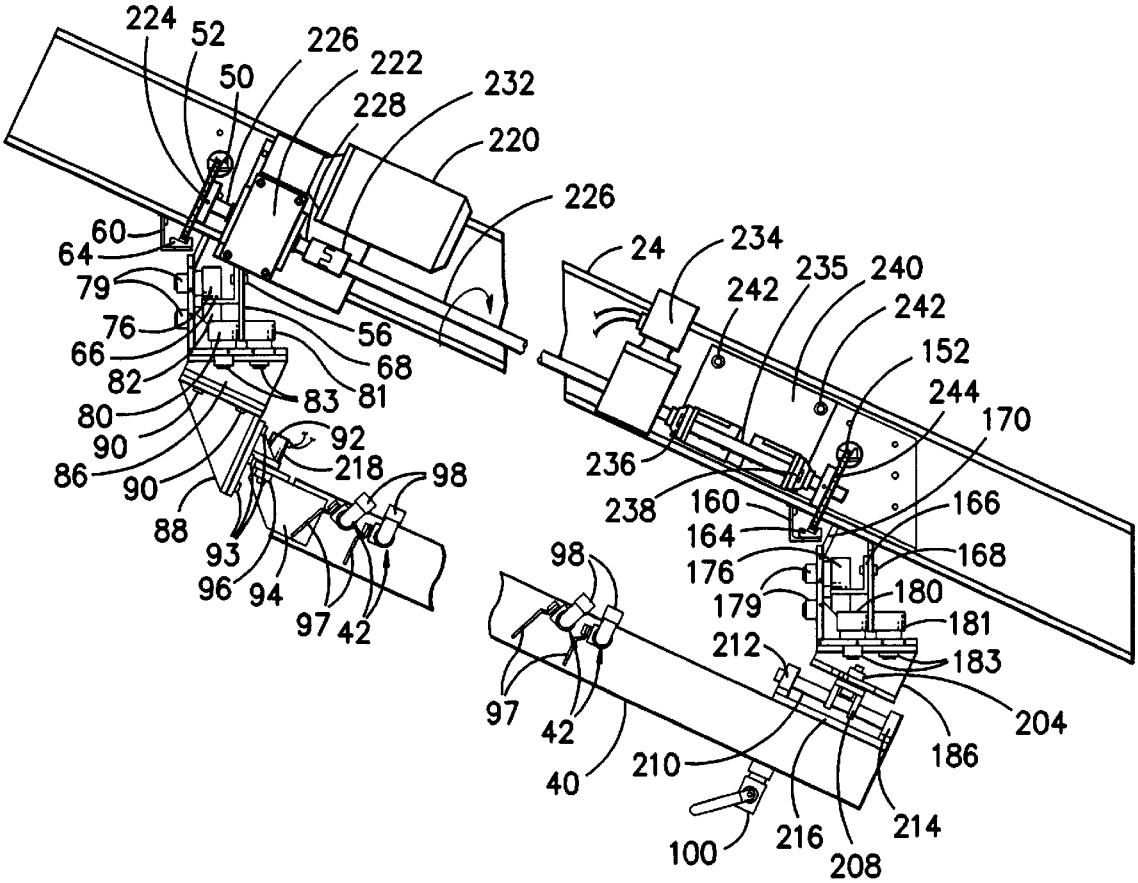
*FIG. —7—*

METHOD AND APPARATUS FOR CLEANING COLORANT APPLICATORS

BACKGROUND OF THE INVENTION

Previously developed washing systems for colorant applicators involved a manifold that was mounted on wheels having V-shaped grooves that rode on top of a V-shaped track. This system had frequent tracking problems ranging from binding to derailment due to the fact that this was a very fixed and rigid structure. Temperature variation is also a significant factor in the derailment and misalignment of the washing system.

The present invention solves these problems in a manner not disclosed in the known prior art.

SUMMARY OF THE INVENTION

This Invention is a method and apparatus for spraying water on the underside of a series of colorant applicators in order to rinse excess colorant from the machine parts. There is a water manifold having a first end portion connected to an upper trolley by a pivoting joint and a second end portion attached to a lower trolley by both a pivoting joint and a sliding joint. Both the upper and lower trollies are constrained in the horizontal, vertical, and rotational direction by a series of cam followers. The extra degrees of freedom provided by the two pivoting joints and the sliding joint insure that no binding occurs. An optional feedback control system can be added utilizing a rotational position transducer to sense the angle of the water manifold so that the motion of the trolleys can be retarded or advanced accordingly.

An advantage of this invention is to eliminate binding and derailing caused by misalignment of an automatic washing system.

Another advantage of this invention is to allow the water manifold to move without restriction as the water manifold elongates or shrinks due to temperature differences in the wash water.

Yet another advantage to this invention is to provide feedback control to make sure that alignment is maintained.

These and other advantages will be in part apparent and in part pointed out below.

BRIEF DESCRIPTION OF THE DRAWINGS

The above as well as other objects of the invention will become more apparent from .the following detailed description of the preferred embodiment of the invention, which when taken together with the accompanying drawings, in which:

FIG. 7 represents a side elevational view of the present invention as shown in FIG. 2 with the addition of a drive mechanism for moving both the upper or first trolley and the lower or second trolley.

Corresponding reference characters indicate corresponding parts throughout the several views of the drawings.

DETAILED DESCRIPTION OF THE PREFFERED EMBODIMENT

Figure 1:
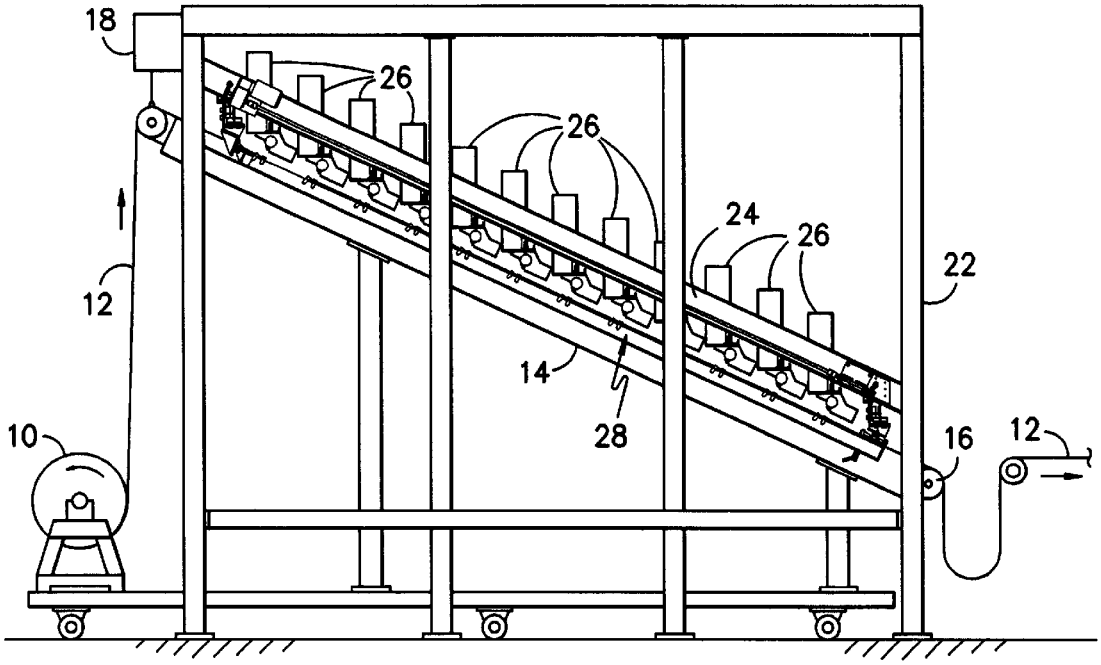
FIG. 1 is a diagrammatic side of the array configuration of a dyeing apparatus of a kind for which the instant invention may be adapted that is depicting a twelve (12) colorant emitting arrays that are positioned above a section of a textile substrate web to be patterned.

This invention is directed to a method and apparatus for cleaning colorant applicators. Referring now by reference numerals to the accompanying drawings, and initially to FIG. 1, which depicts, in a side elevational view, a set of twelve (12) individual arrays or liquid jet gunbars 26 positioned within a frame 22. These liquid jet gunbars 26 form a part of a patterning dying machine to which the present invention is particularly suited. This machine can color any type of textile substrate, including, but not limited to carpeting. A preferred type of colorant would be a dye. Details of this patterning technology can be found in commonly assigned U.S. Pat. No. , 5,432,502, issued Jul. 11, 1995; U.S. Pat. No. 5,161,395, Issued Nov. 10, 1992; U.S. Pat. No. 5,325,556, issued Jul. 6, 1994; U.S. Pat. No. 5,408,308, issued Apr. 18, 1995; and U.S. Pat. No. 5,432,502, issued Jul. 11, 1995, all of these disclosures are hereby incorporated by reference as if fully set forth herein.

Each liquid jet gunbar 26 is comprised of a series of colorant jets, arranged in spaced alignment, which extend generally above and across the width of the textile substrate 12 and are suitably supported at their ends by attachments to a pair of diagonal frame members, the first of which is depicted by numeral 24, on each side of the conveyor assembly 14. The movable conveyor assembly 14 is fully disclosed in U.S. Pat. No. 5,161,395, issued on Nov. 10, 1992, which disclosure is hereby incorporated by reference as if fully set forth herein. A textile substrate 12 is supplied by roll 10 and is transported in turn under each liquid jet gunbar 26 by conveyor assembly 14 driven by a suitable motor indicated by numeral 16. There is a power control system which operates all solenoid valves within the liquid jet gunbars 26 to pattern the textile substrate 12. Pattern information is transmitted at an appropriate time in response to movement by conveyor assembly 14 that is detected by suitable rotary motion sensors in the form of a transducer 18 that is operably associated with conveyor assembly 14 and connected to a pattern control system. The automatic washing apparatus of the present invention is generally indicated in FIG. 1 by numeral 28.

Figure 2:
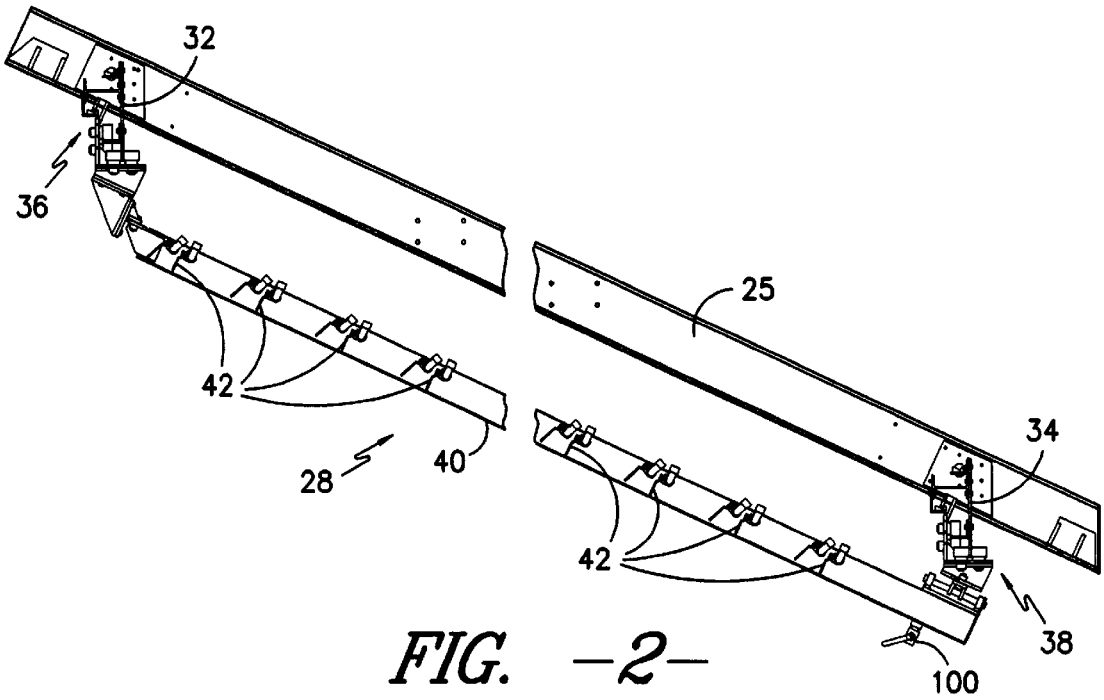
FIG. 2 is an isolated elevational of side view of the apparatus of the present invention including a water manifold, an upper or first trolley with an associated upper or first track and a lower or second trolley with an associated lower or second track, where the upper or first track and lower or second track are attached to a support member of a frame that supports the colorant emitting arrays.

Referring now to FIG. 2, there is a second diagonal frame member 25 that is directly aligned with the first diagonal frame 24. Attached between diagonal frame 24 and diagonal frame 25 and perpendicular thereto is an upper or first track 32 and a lower or second track 34. Moveably engaging first track member 32 is an upper or first trolley 36. Moveably engaging second track member 34 is a lower or second trolley 38. Attached to first trolley 36 and second trolley 38 is a liquid manifold 40. By means of the first trolley 36 and the second trolley 38 the liquid manifold 40 is able to traverse the lateral width of the conveyor assembly 14 and provide at least one high pressure jet generally indicated by numeral 42 located underneath each liquid jet gunbar 26 to spray liquid on each liquid jet gunbars 26 to provide cleaning thereof. The preferred liquid is water under pressure that can be in the range of 10 to 1,000 pounds per square inch gauge (p.s.i.g.), with a more practical operating range of 30 to 400 pounds per square inch gauge (p.s.i.g.) and a preferred range of sixty (60) to two hundred (200) pounds per square inch gauge (p.s.i.g.).

The preferred number of high pressure jets 42 located underneath each liquid jet gunbar is four (4). As shown in FIG. 7, the high pressure jet 42 includes a valve 97 for supplying the high pressure liquid through a jet spray device 98. The preferred material and structure for the liquid manifold 40 is a stainless steel rectangular pipe, however, a wide variety of materials and enclosed fluid conducting structures will suffice including, but not limited to polyvinyl chloride.

Figure 3:
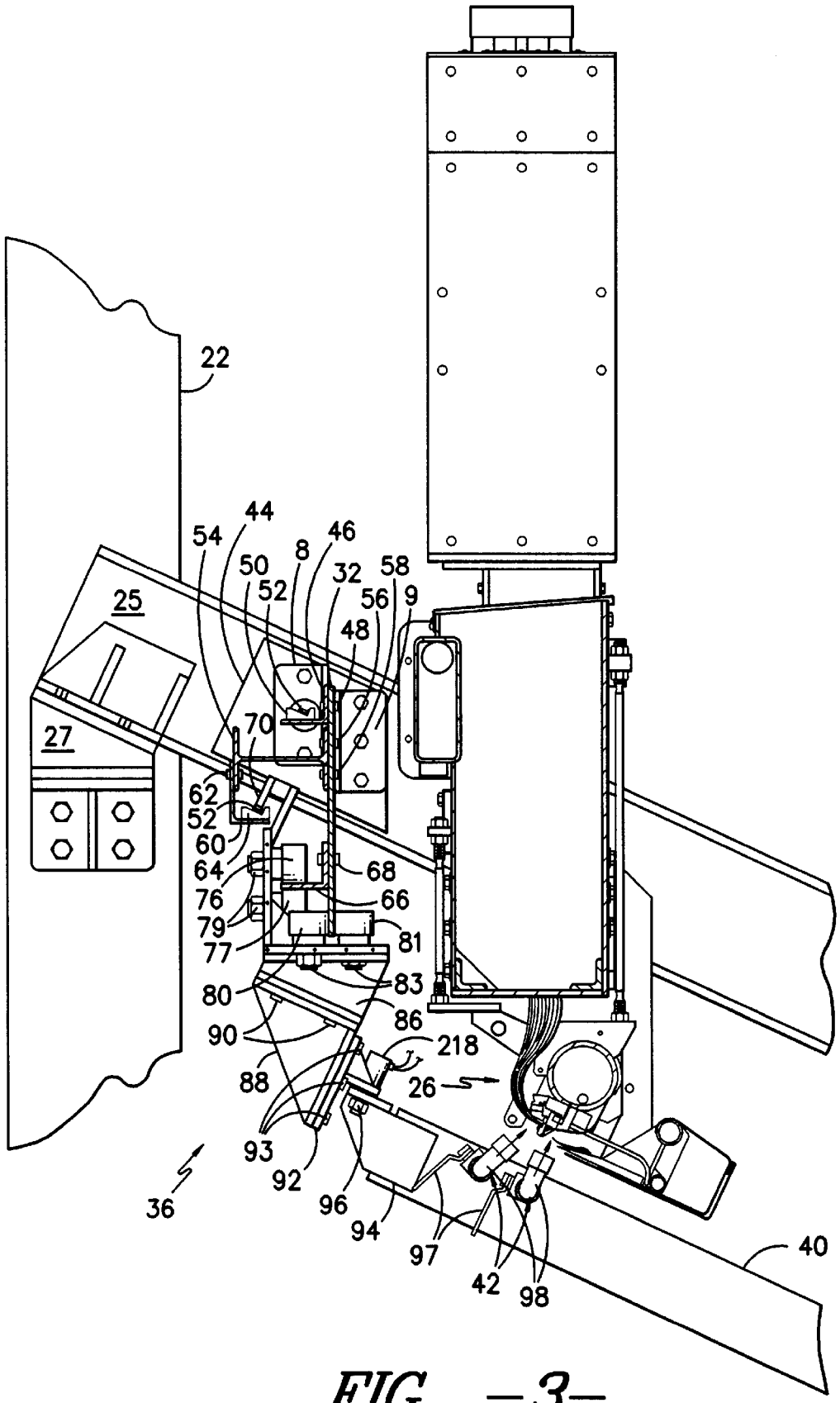
FIG. 3 is an isolated view of the upper or first track and upper or first trolley of the cleaning apparatus as found in FIG. 2.

Referring now to FIG. 3, a frame 22 is attached to the second diagonal frame member 25 by means of an angle bracket 27. The first track member 32 is secured onto diagonal frame 25 by means of a first mounting bracket 44 and a first angle bracket 8 and a second angle bracket 9. This is replicated for the other side of first track 32 with regard to first diagonal frame member 24 (not shown). The first track member 32 has a first L-shaped member 46 attached to the top of first track member 32 by means of a first nut and bolt combination 48. The first L-shaped member 46 supports a first chain guide 50 having a V-shaped notch that supports the first chain 52. Mounted below the first L-shaped member 46 is a first I-beam member 54 having a base that is a attached to the first track member 32 by means of a second nut and bolt combination member 56 and a third nut and bolt combination 58 at the top portion of the bottom flange of the first I-beam member 54 and the bottom portion of the bottom flange of the first I-beam member 54, respectively. The upper portion of first I-beam member 54 has a bottom portion that is connected by means of a fourth nut and bolt combination 62 to a second L-shaped member 60. This second L-shaped member 60 supports a second chain guide 64 that is substantially similar to first chain guide 50. Chain guides 50 and 64 allow for the smooth passage of the first chain 52. Located near the bottom portion of the first track member 32 is a third L-shaped member 66 that is attached by means of a fifth nut and bolt combination 68.

Figure 5:
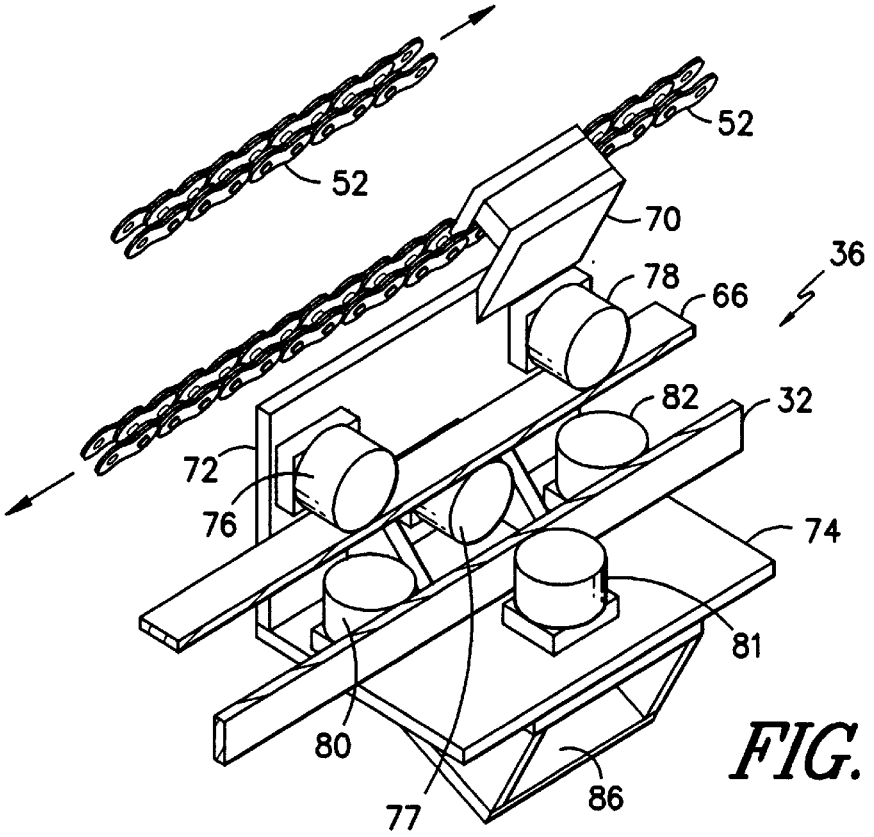
FIG. 5 is an isolated prospective view of the upper or first trolley including a series of cam followers and an engagement mechanism for a drive chain.

Referring now to FIGS. 3 and 5, the first trolley 36 includes a first U-shaped engagement member 70 that attaches to the first chain 52 to move the first trolley 36 along the first track member 32. The first U-shaped engagement member 70 is fixedly attached to a first vertical trolley member 72 that is attached at a right angle to a first horizontal member 74. Fixedly attached to the first vertical trolley member 72 is the first series of cam followers depicted by numerals 76, 77, and 78, respectively. These first series of cam followers 76, 77, and 78, engage a lower portion of the third L-shaped member 66 and rotate to provide movement of the upper or first trolley 36 along the upper or first track member 32. Cam followers 76 and 78 engage the upper face of the lower portion of the third L-shaped member 66 while cam follower 77 is located underneath the lower portion of third L-shaped member 66 and positioned between cam follower 76 and cam follower 78. In a similar manner, there is a second series of cam followers 80, 81, and 82 that are mounted on the face of the first horizontal trolley member 74. As shown in both FIG. 5 and FIG. 3, the very lower bottom portion of the upper first track member 32 engages cam followers 80 and 82 on the left hand side and cam follower 81 on the right hand side to provide movement of the upper or first trolley 36 along the upper or first track member 32. Cam followers 76, 77, and 78 are attached to vertical trolley member 72 by a first series of nuts 79 while the second series of cam followers 80, 81, 82 are attached to the horizontal trolley member 74 by a second series of nuts 83. An illustrative, nonlimiting example of cam followers 76, 77, 78, 80, 81, and 82 includes Part #CCF-2-1/2-S manufactured by McGill Manufacturing Company, Inc. located at 909 N. Lafayette St., Valparaiso, Ind. 46383.

The first horizontal trolley member 74 is attached to a first trapezoidal support member 86. The first trapezoidal member 86 is attached to a fourth L-shaped member 88 by a first series of attachment nuts and bolts 90 (preferably four (4)). There is a first pivotable attachment bracket 92 that is attached to a first liquid manifold bracket 94 by means of a first pivot 96. This simple rotational position transducer can be used to sense the angle of the manifold and the motion of one of the trolleys can be retarded or advanced accordingly using the phase adjuster 234 shown in FIG. 7. A typical, but nonlimiting, example of a rotational position transducer 204 of this type is Part #1520, manufactured by Reliance Electric Company, located at 6065 Parkland Blvd., Cleveland, Ohio 44124-6080. The first pivotable attachment bracket 92 is attached to the fourth L-shaped member 88 by a second series of attachment nut and bolts 93 (preferably six (6)). The first liquid manifold bracket 94 is attached to the liquid manifold 40. There is liquid discharge valve 100 located on the underside of the liquid manifold 40, as shown in FIGS. 2 and 4.

Figure 4:
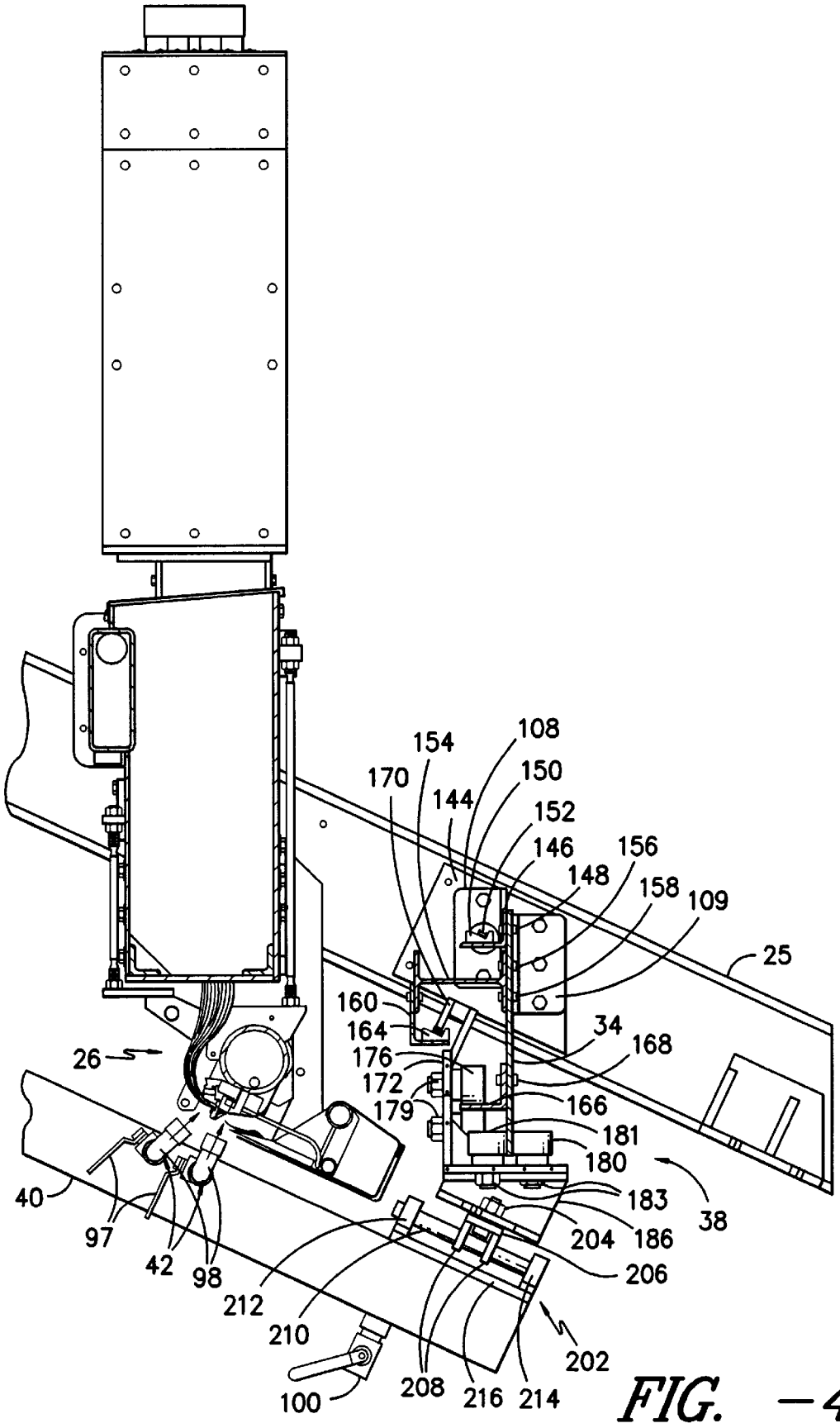
FIG. 4 is an isolated view of the lower or second trolley and the lower or second track of the cleaning apparatus as found in FIG. 2.

Referring now to FIG. 4, which is a depiction of the lower or second track member 34 and the lower or second trolley 38. The second track member 34 is secured onto diagonal frame 25 by means of a second mounting bracket 144 and a third angle bracket 108 and a second angle bracket 109. This is replicated for the other side of the second track 34 with regard to the first diagonal frame member 24 (not shown). The second track member 34 has a fifth L-shaped member 146 attached to the top of the lower or second track member 34 by means of a sixth nut and bolt combination 148. The fifth L-shaped member 146 supports a second chain guide 150 having a V-shaped notch that supports the second chain 152. Mounted below the fifth L-shaped member 146 is a second I-beam member 154 having a base that is a attached to the second track member 34 by means of a seventh nut and bolt combination member 156 and an eighth nut and bolt combination 158 at the top portion of the bottom flange of the second I-beam member 154 and the bottom portion of the bottom flange of the second I-beam member 154, respectively. The upper portion of second I-beam member 154 has a bottom portion that is connected by means of a ninth nut and bolt combination 162 to a sixth L-shaped member 160. This sixth L-shaped member 160 supports a fourth chain guide 164 that is substantially similar to the third chain guide 150. Chain guides 150 and 164 allow for the smooth passage of the second chain 152 therethrough. Located near the bottom portion of the second track member 34 is a seventh L-shaped member 166 that is attached by means of a tenth nut and bolt combination 168.

Figure 6:
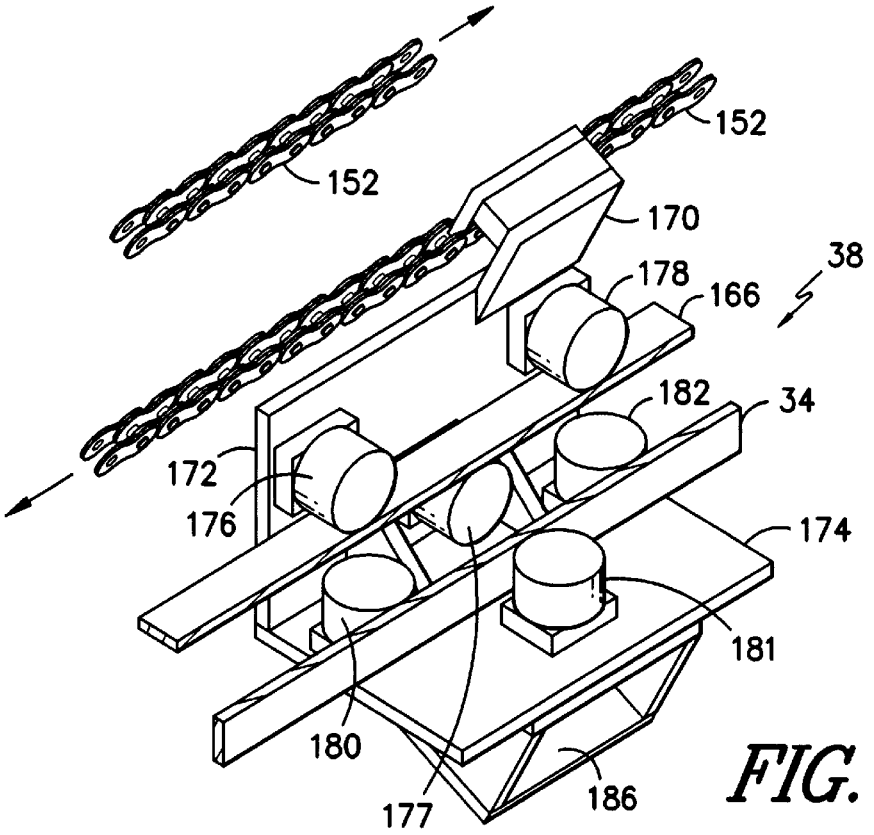
FIG. 6 is an isolated prospective view of the lower or second trolley including a series of cam followers and an engagement mechanism for a drive chain.

Referring now to FIGS. 4 and 6, the second trolley 38 includes a second U-shaped engagement member 170 that attaches to the second chain 152 to move the second trolley 38 along the second track member 34. The second U-shaped engagement member 170 is fixedly attached to a second vertical trolley member 172 that is attached at a right angle to a second horizontal trolley member 174. Fixedly attached to the second vertical trolley member 172 is a third series of cam followers depicted by numerals 176, 177, and 178, respectively. This third series of cam followers 176, 177, and 178, engage a lower portion of the seventh L-shaped member 166 and rotate to provide movement of the lower or second trolley 38 along the lower or second track member 34. Cam followers 176 and 178 engage the upper face of the lower portion of the seventh L-shaped member 166 while cam follower 177 is located underneath the lower portion of sixth L-shaped member 166 and positioned between cam follower 176 and cam follower 178. In a similar manner, there is a fourth series of cam followers 180, 181, and 182 that are mounted on the face of the second horizontal trolley member 174. As shown in both FIG. 6 and FIG. 4, the very lower bottom portion of the lower or second track member 34 engages cam followers 180 and 182 on the left hand side and cam follower 181 on the right hand side to provide movement of the lower or second trolley 38 along the lower or second track member 34. The third series of cam followers 176, 177, and 178 are attached to second vertical trolley member 172 by a third series of nuts 179 while the fourth series of cam followers 180, 181, 182 are attached to the second horizontal trolley member 174 through a second trapezoidal support member 186 by means of a fourth series of nuts 183. An illustrative, nonlimiting example of cam followers 176, 177, 178, 180, 181, and 182 includes Part #CCF-2-1/2-S manufactured by McGill Manufacturing Company, Inc. located at 909 N. Lafayette St., Valparaiso, Ind. 46383.

The second trapezoid support member 186 is attached to a linear bearing as generally indicated by numeral 202. The second trapezoidal support member 186 is attached to a swivel joint 204 that is attached to a bearing yolk 206 having a pair of linear bearings 208 attached thereto. The pair of linear bearings 208 move along a shaft 210 that is secured at each end by a first shaft bracket 212 and a second shaft bracket 214. A typical, but nonlimiting, example of a swivel joint 204 of this type is a ¾ inch shoulder bolt. The first shaft bracket 212 and the second shaft bracket 214 are attached to a base support 216 that is attached to the liquid manifold 40. A rotational encoder 218 is coupled to the first pivot 96 to provide feedback to a control system that monitors the relative position of the trolleys.

Referring now to FIG. 7, the first chain 52 is rotated by means of a motor 220 that is attached to a gear box 222, both of which are attached to the first diagonal frame member 24. An illustrative, but nonlimiting example of a motor 220 is a 230 volt a.c. motor. The first chain 52 is rotated by means of a first sprocket 224 which is attached to an outer rotating shaft 226 that is connected to a gear box 222. A typical, but nonlimiting, example of a gear box 222 of this type is Part # FWA 726-200-B5-H, manufactured by Boston Gear located at 14 Hayward Street, North Quincy, Mass. 02171-2418.

There is an inner rotating shaft 228 that is attached to a first coupling 232 that is attached to a drive shaft 226. This drive shaft 226 is connected to a phase adjuster 234. This phase adjuster 234 attaches to a bearing shaft 235 that is enclosed by a first bearing 236 and a second bearing 238. A typical, but nonlimiting, example of either first bearing 236 or second bearing 238 includes Part # FWA 726-200-B5-H, manufactured by Fafnir Bearings located at 1 Lake Bellevue Drive, Bellevue, Wash. 98005-2417. First bearing 236 and second bearing 238 are mounted on a bearing support plate 240 that is bolted by a series of nut and bolts 242 to the first diagonal frame member 24. The opposite end of the bearing shaft 235 is connected to a second sprocket 244 which engages the second chain 152. This provides movement for both the upper or first trolley 36 and the lower or second trolley 38 along the first upper track member 32 or the second or lower track member 34, respectively. It is not intended that the scope of the invention be limited to the specific embodiment illustrated and described, rather, it is intended that the scope of the invention be defined by the appended claims and their equivalents.

What is claimed:

1. An apparatus for spraying liquid on the underside of a series of colorant applicators comprising of:

(a) a frame for supporting said series of colorant applicators;

(b) a first track attached to said frame and a second track attached to said frame;

(c) a first trolley that is moveably attached to said first track;

(d) a second trolley that is moveably attached to said second track; and (e) a liquid manifold, having a first end portion and a second end portion and having a plurality of liquid jets for spraying said underside of a series of colorant applicators with liquid under pressure, wherein said first end portion of said liquid manifold is attached to said first trolley by means of a first pivoting joint and said second end portion of said liquid manifold is attached to a sliding joint that is attached to a second pivoting joint that is attached to said second trolley.

2. An apparatus for spraying liquid on the underside of a series of colorant applicators as defined by claim 1, wherein said first track, having a longitudinal axis, includes a first endless chain that encircles a first rotatable chain engaging mechanism and a second rotatable chain engaging mechanism wherein said first endless chain extends substantially parallel to said longitudinal axis of said first track and adjacent thereto and wherein said second track, having a longitudinal axis, includes a second endless chain that encircles a third rotatable chain engaging mechanism and a fourth rotatable chain engaging mechanism wherein said second endless chain extends substantially parallel to said longitudinal axis of said second track and adjacent thereto and a first mechanism for rotating said first rotatable chain engaging mechanism and a second mechanism for rotating said third rotatable chain engaging mechanism.

3. An apparatus for spraying liquid on the underside of a series of colorant applicators as defined by claim 2, wherein said first mechanism for rotating said first rotatable chain engaging mechanism includes a motor attached to a gearbox having a rotating axle extending therefrom that is attached to said first rotatable chain engaging mechanism.

4. An apparatus for spraying liquid on the underside of a series of colorant applicators as defined by claim 3, wherein said second mechanism for rotating said third rotatable chain engaging mechanism includes a rotating shaft attached to said gearbox and attached to said third rotatable chain engaging mechanism.

5. An apparatus for spraying liquid on the underside of a series of colorant applicators as defined by claim 2, wherein said first rotatable chain engaging mechanism includes a first gear, said second rotatable chain engaging mechanism includes a second gear, said third rotatable chain engaging mechanism includes a third gear, and said fourth rotatable chain engaging mechanism includes a fourth gear.

6. An apparatus for spraying liquid on the underside of a series of colorant applicators as defined by claim 1, wherein said first pivoting joint includes a first swivel joint and said second pivoting joint includes a second swivel joint.

7. An apparatus for spraying liquid on the underside of a series of colorant applicators as defined by claim 1, wherein said first sliding joint includes a shaft attached to said liquid manifold by a first shaft bracket and a second shaft bracket and a slidably attached to said shaft is at least one linear bearing having a bearing yoke attached thereto wherein said bearing yoke is attached to said second pivoting joint.

8. An apparatus for spraying liquid on the underside of a series of colorant applicators as defined by claim 1, further comprising a first trapezoidal support member attached to said first trolley and an L-shaped member wherein said L-shaped member is attached to said first swivel joint.

9. An apparatus for spraying liquid on the underside of a series of colorant applicators as defined by claim 1, further comprising a second trapezoidal support member attached to said second trolley and said second swivel joint.

10. An apparatus for spraying liquid on the underside of a series of colorant applicators as defined by claim 2, wherein said first trolley includes a first engagement member that is attached to said first endless chain and said second trolley includes a second engagement member that is attached to said second chain.

11. An apparatus for spraying liquid on the underside of a series of colorant applicators as defined by claim 1, wherein said first track includes a first substantially horizontal track member, having a top portion and a bottom portion, and a first substantially vertical track member, having a top portion and a bottom portion, wherein said first trolley includes a first substantially vertical trolley member and a second substantially horizontal trolley member.

12. An apparatus for spraying liquid on the underside of a series of colorant applicators as defined by claim 11, wherein said first substantially vertical trolley member has a plurality of first rotatable cam followers attached thereto that engage said first substantially horizontal track member with at least one first rotatable cam follower adjacent to said top portion and at least one first rotatable cam follower adjacent to said bottom portion of said first substantially horizontal track member and wherein said first substantially horizontal trolley member has a plurality of second rotatable cam followers attached thereto that engage said first substantially vertical track member with at least one first rotatable cam follower adjacent to said top portion and at least one first rotatable cam follower adjacent to said bottom portion of said first substantially vertical track member for movement of said first trolley along said first track.

13. An apparatus for spraying liquid on the underside of a series of colorant applicators as defined by claim 1, wherein said second track includes a first substantially horizontal track member, having a top portion and a bottom portion, and a first substantially vertical track member, having a top portion and a bottom portion, wherein said second trolley includes a first substantially vertical trolley member and a second substantially horizontal trolley member.

14. An apparatus for spraying liquid on the underside of a series of colorant applicators as defined by claim 13, wherein said first substantially vertical trolley member has a plurality of first rotatable cam followers attached thereto that engage said first substantially horizontal track member with at least one first rotatable cam follower adjacent to said top portion and at least one first rotatable cam follower adjacent to said bottom portion of said first substantially horizontal track member and wherein said first substantially horizontal trolley member has a plurality of second rotatable cam followers attached thereto that engage said first substantially vertical track member with at least one first rotatable cam follower adjacent to said top portion and at least one first rotatable cam follower adjacent to said bottom portion of said first substantially vertical track member for movement of said second trolley along said second track.

15. An apparatus for spraying liquid on the underside of a series of colorant applicators as defined by claim 1, wherein said plurality of liquid jets are able to direct liquid against said underside of said series of colorant applicators at a pressure of 10 to 1,000 pounds per square inch gauge (p.s.i.g.).

16. An apparatus for spraying liquid on the underside of a series of colorant applicators as defined by claim 1, wherein said plurality of liquid jets are able to direct liquid against said underside of said series of colorant applicators at a pressure of 30 to 400 pounds per square inch gauge (p.s.i.g.).

17. An apparatus for spraying liquid on the underside of a series of colorant applicators as defined by claim 1, wherein said plurality of liquid jets are able to direct liquid against said underside of said series of colorant applicators at a pressure of 60 to 200 pounds per square inch gauge (p.s.i.g.).

18. An apparatus for spraying liquid on the underside of a series of colorant applicators as defined by claim 1, wherein said liquid manifold includes a liquid discharge valve.

19. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of a first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators.

20. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of a first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators wherein said first track, having a longitudinal axis, includes a first endless chain that encircles a first rotatable chain engaging mechanism and a second rotatable chain engaging mechanism wherein said first endless chain extends substantially parallel to said longitudinal axis of said first track and adjacent thereto and wherein said second track, having a longitudinal axis, includes a second endless chain that encircles a third rotatable chain engaging mechanism and a fourth rotatable chain engaging mechanism wherein said second endless chain extends substantially parallel to said longitudinal axis of said second track and adjacent thereto and a first mechanism for rotating said first rotatable chain engaging mechanism and a second mechanism for rotating said third rotatable chain engaging mechanism.

21. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of a first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators wherein said first track, having a longitudinal axis, includes a first endless chain that encircles a first rotatable chain engaging mechanism and a second rotatable chain engaging mechanism wherein said first endless chain extends substantially parallel to said longitudinal axis of said first track and adjacent thereto and wherein said second track, having a longitudinal axis, includes a second endless chain that encircles a third rotatable chain engaging mechanism and a fourth rotatable chain engaging mechanism wherein said second endless chain extends substantially parallel to said longitudinal axis of said second track and adjacent thereto and a first mechanism for rotating said first rotatable chain engaging mechanism and a second mechanism for rotating said third rotatable chain engaging mechanism, wherein said first mechanism for rotating said first rotatable chain engaging mechanism includes a motor attached to a gearbox having a rotating axle extending therefrom that is attached to said first rotatable chain engaging mechanism and wherein said second mechanism for rotating said third rotatable chain engaging mechanism includes a rotating shaft attached to said gearbox and attached to said third rotatable chain engaging mechanism.

22. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of a first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators wherein said first track, having a longitudinal axis, includes a first endless chain that encircles a first gear a second gear wherein said first endless chain extends substantially parallel to said longitudinal axis of said first track and adjacent thereto and wherein said second track, having a longitudinal axis, includes a second endless chain that encircles a third gear and a fourth gear wherein said second endless chain extends substantially parallel to said longitudinal axis of said second track and adjacent thereto and a first mechanism for rotating said first gear and a second mechanism for rotating said third gear, wherein said first mechanism for rotating said first gear includes a motor attached to a gearbox having a rotating axle extending therefrom that is attached to said first gear and wherein said second mechanism for rotating said third gear includes a rotating shaft attached to said gearbox and attached to said third gear.

23. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of a first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators wherein said first pivoting joint includes a first swivel joint and said second pivoting joint includes a second swivel joint.

24. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of a first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators wherein said first sliding joint includes a shaft attached to said liquid manifold by a first shaft bracket and a second shaft bracket and a slidably attached to said shaft is at least one linear bearing having a bearing yoke attached thereto wherein said bearing yoke is attached to said second pivoting joint.

25. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of a first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators and further comprising a first trapezoidal support member attached to said first trolley and an L-shaped member wherein said L-shaped member is attached to said first swivel joint and a second trapezoidal support member is attached to said second trolley and said second swivel joint.

26. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of a first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators wherein said first track, having a longitudinal axis, includes a first endless chain that encircles a first rotatable chain engaging mechanism and a second rotatable chain engaging mechanism wherein said first endless chain extends substantially parallel to said longitudinal axis of said first track and adjacent thereto and wherein said second track, having a longitudinal axis, includes a second endless chain that encircles a third rotatable chain engaging mechanism and a fourth rotatable chain engaging mechanism wherein said second endless chain extends substantially parallel to said longitudinal axis of said second track and adjacent thereto and a first mechanism for rotating said first rotatable chain engaging mechanism and a second mechanism for rotating said third rotatable chain engaging mechanism and wherein said first trolley includes a first engagement member that is attached to said first endless chain and said second trolley includes a second engagement member that is attached to said second chain.

27. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of at first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators and wherein said first track includes a first substantially horizontal track member, having a top portion and a bottom portion, and a first substantially vertical track member, having a top portion and a bottom portion, wherein said first trolley includes a first substantially vertical trolley member and a second substantially horizontal trolley member and wherein said first substantially vertical trolley member has a plurality of first rotatable cam followers attached thereto that engage said first substantially horizontal track member with at least one first rotatable cam follower adjacent to said top portion and at least one first rotatable cam follower adjacent to said bottom portion of said first substantially horizontal track member and wherein said first substantially horizontal trolley member has a plurality of second rotatable cam followers attached thereto that engage said first substantially vertical track member with at least one first rotatable cam follower adjacent to said top portion and at least one first rotatable cam follower adjacent to said bottom portion of said first substantially vertical track member for movement of said first trolley along said first track and wherein said second track includes a first substantially horizontal track member, having a top portion and a bottom portion, and a first substantially vertical track member, having a top portion and a bottom portion, wherein said second trolley includes a first substantially vertical trolley member and a second substantially horizontal trolley member and wherein said first substantially vertical trolley member has a plurality of first rotatable cam followers attached thereto that engage said first substantially horizontal track member with at least one first rotatable cam follower adjacent to said top portion and at least one first rotatable cam follower adjacent to said bottom portion of said first substantially horizontal track member and wherein said first substantially horizontal trolley member has a plurality of second rotatable cam followers attached thereto that engage said first substantially vertical track member with at least one first rotatable cam follower adjacent to said top portion and at least one first rotatable cam follower adjacent to said bottom portion of said first substantially vertical track member for movement of said second trolley along said second track.

28. A process for spraying liquid on the underside of a series of colorant applicators, which comprises:

moving a liquid manifold, having a first end portion and a second end portion, and having a plurality of liquid jets underneath said series of colorant applicators and applying liquid under pressure from said plurality of liquid jets under pressure, wherein said first end portion of said liquid manifold is attached to a first trolley by means of a first pivoting joint and said second end portion of said liquid manifold is attached to a sliding joint that is attached to a second pivoting joint that is attached to a second trolley wherein said first trolley is moveably attached to a first track and said second trolley is moveably attached to said second track wherein said first track and said second track are attached to a frame that supports said plurality of colorant applicators and said plurality of liquid jets are able to direct liquid against said underside of said series of colorant applicators at a pressure of 10 to 1,000 pounds per square inch gauge (p.s.i.g.).

* * * * *